United States Patent [19]

Kimble

[11] 4,359,064

[45] Nov. 16, 1982

[54] FLUID POWER CONTROL APPARATUS

[76] Inventor: Charles W. Kimble, 1805 Jackson Rd., Zanesville, Ohio 43701

[21] Appl. No.: 171,892

[22] Filed: Jul. 24, 1980

[51] Int. Cl.[3] ..... F15B 13/02

[52] U.S. Cl. ..... 137/269; 137/271; 137/596.16; 137/625.64; 137/884

[58] Field of Search ..... 137/271, 596.16, 625.64, 137/884, 269

[56] References Cited

U.S. PATENT DOCUMENTS

| | | | |
|---|---|---|---|
| 3,504,704 | 4/1970 | Beckett et al. | 137/625.64 |
| 3,513,876 | 5/1970 | Tarbox | 137/884 X |
| 3,589,387 | 6/1971 | Raymond | 137/884 X |
| 3,756,274 | 9/1973 | Wolfgramm | 137/271 X |
| 3,766,943 | 10/1973 | Murata | 137/884 |
| 3,976,098 | 8/1976 | Raymond | 137/884 |
| 4,181,141 | 1/1980 | Stoll et al. | 137/884 X |
| 4,293,004 | 10/1981 | Lowe | 137/884 |

FOREIGN PATENT DOCUMENTS

| | | | |
|---|---|---|---|
| 1206828 | 9/1970 | United Kingdom | 137/884 |

*Primary Examiner*—Gerald A. Michalsky

[57] ABSTRACT

A fluid power control apparatus comprising a plurality of standardized multiple-function modules adapted to be selectively programmed in various arrays to effect substantially any required hydraulic valve and system function.

23 Claims, 25 Drawing Figures

FLUID POWER CONTROL APPARATUS

BACKGROUND OF THE INVENTION

This invention relates generally to hydraulic apparatus and more particularly to standardized modular components and arrangements thereof, for constructing various fluid power control systems by manifolding together a plurality of the modular components, so as to effect various selected control functions.

PROBLEMS IN THE ART

In the fabrication of hydraulic control systems for the industrial field as well as control valve assemblies for military mobile equipment and other uses where controled fluid power systems are required, it has been the practice in the art to fabricate the control system from a variety of control valves individually mounted on bases with flow paths entering and exiting the same interface and inter-connected by external piping to perform the circuit control function.

In another instance, it is the practice in the art to join together such valves and components in adjacent relationship so as to eliminate some external piping by bolting together housings of individual components. This approach has resulted in the elimination of certain external piping but the applications have been specialized and have consisted of custom housings constructed for a particular function and capped by custom end closures or by the system's directional control valve without any provision for standarization and interchangeability of multiple-function modular components.

Such conventional approaches to control systems have inherently required a plurality of different control functions and hence a plurality of both standard and specially designed valves with the result that each valve has been incorporated in the control system as a separate unit constructed of its own specialized components and features.

SUMMARY OF THE INVENTION

It is a primary object of the present invention to provide a novel system of standarized components for constructing substantially any hydraulic control valve or to be manifolded into complete multiple-function hydraulic control systems from a plurality of standardized multiple function modules.

As another object of the present invention, the modules include a novel standarized control valve housing that incorporates standardized porting with four standardized power flow duct-forming passages which extend through the valve housing and two standardized signal flow duct-forming passages which also extend through the valve housing so as to permit manifolding a plurality of the valve housings together to achieve various selected applications.

As another object of the present invention, the above mentioned standardized control valve housing uniquely includes seven internal chambers. Two of the chambers are signal flow end chambers respectively located at opposite ends of a power flow spool. The other five chambers are power flow chambers with a passage interconnecting two of these power flow chambers such that functionally there are four power flow chambers each connected to one of the four through power flow duct-forming passages and selectively programmed by a standarized multiple function porting means to effect switching of the power flow between selected duct-forming passages.

It is another object of the present invention, the above mentioned multiple function porting means includes internal porting elements that are uniquely adapted at each end to accept spacers in various selected spacer arrangements. A spacer mounted at each end positions the porting elements in a center position whereas both spacers at either end positions the porting elements in the offset position. Such selective programming of standardized spacers effects various porting options with porting elements in neutral position.

As another object of the present invention, the previously mentioned control valve housing includes a unique feature in that the two through signal flow duct-forming passages are selectively programmable either to communicate with the signal flow end chambers at each end of the internal porting elements to effect switching action between power flow duct-forming passages, or to pass through the valve housing isolated from said end chambers to perform additional signal flow functions at a subsequent module located in the system.

As another object of the present invention, the above mentioned standardized control valve housing includes a third standard interface that provides means to mount multiple standardized pilot modules provided with standardized signal flow porting communicating with the four power flow duct-forming passages, the two signal flow duct-forming passages and each end of the internal porting.

As another object of the present invention, a novel pilot adapter module which mounts to the above mentioned third standard interface is arranged to operate the internal power flow switching element in either direction from signals transmitted by additional pilot modules mounted in the same direction. The pilot adapter module contains means for securing additional pilot modules and means for removing the entire pilot assembly from the control valve assembly from the control valve housing in a single unit.

As another object of the present invention, a unique system is provided for a standardized multiple-function pilot valve module adapted to communicate with the above mentioned pilot adapter module and additional multiple-function pilot valve modules so as to permit the fabrication of substantially any composite hydraulic control circuit from a relatively small inventory of standardized multiple-function modules.

As still another object of the present invention, the above mentioned fluid power control system comprises novel means for joining together the above mentioned multiple-function pilot modules in selected arrays. In general this is accomplished by a plurality of rods of standardized pre-selected length which cooperate with standardized mounting holes in and through the above mentioned modules to provide fexibility in assembling a variety of selected control systems.

DESCRIPTION OF THE PREFERRED EMBODIMENT

Figure 1:
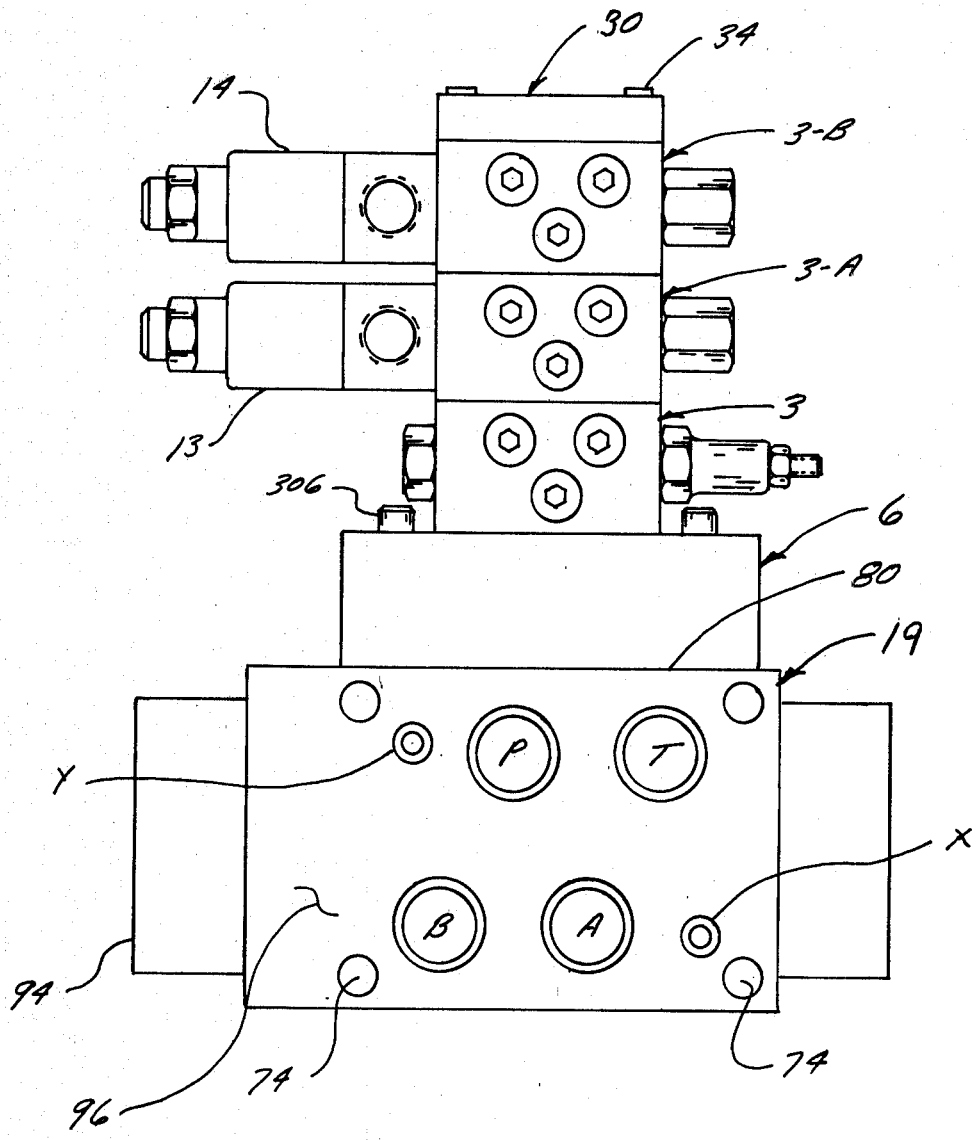
FIG. 1 is a front elevational view of a four way directional control apparatus constructed from the standardized modules of the present invention.
Figure 2:
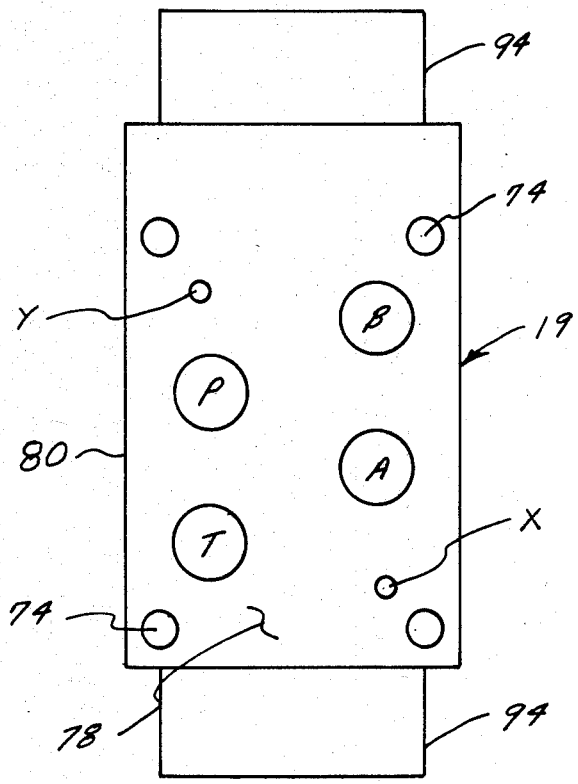
FIGS. 2, 3 and 4 are left, bottom and end elevational views, respectively of a main power valve module comprising a portion of the assembly of FIG. 1.
Figure 3:
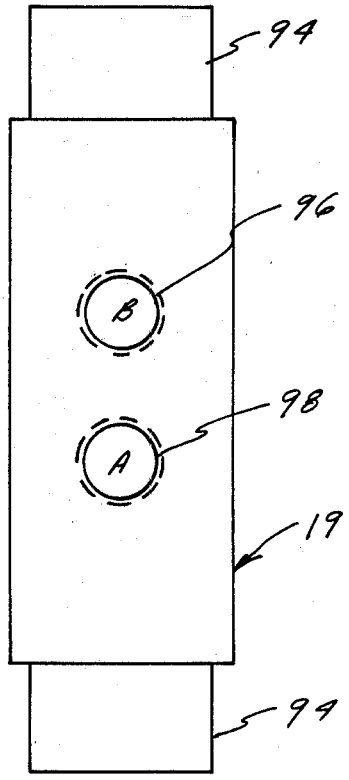
Figure 4:
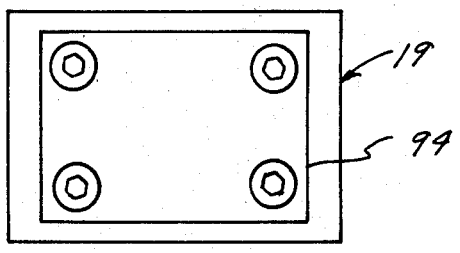
Figure 6:
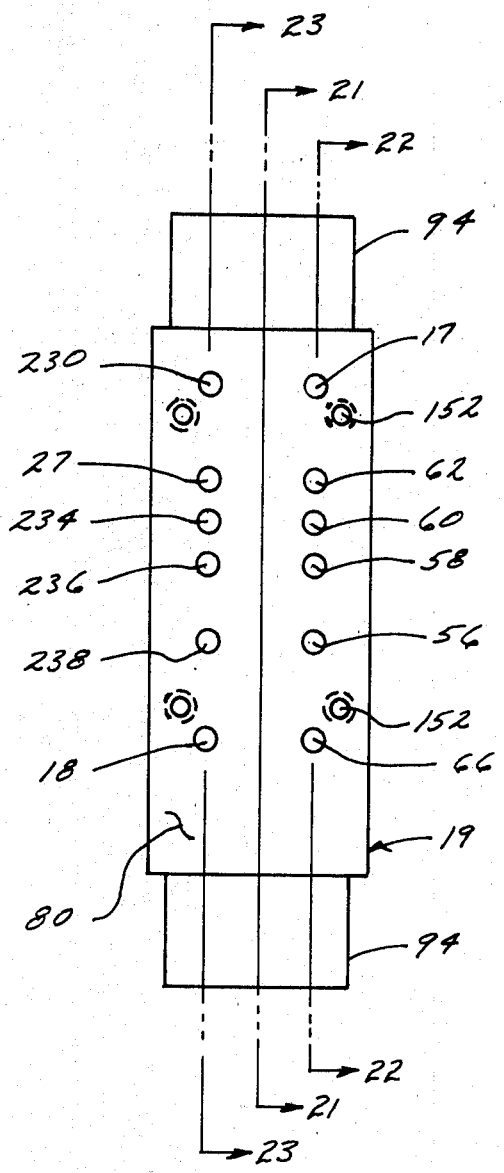
FIGS. 5,6 and 7 are right, top and end elevational views respectively of the main power valve module of FIGS. 2–4.
Figure 5:
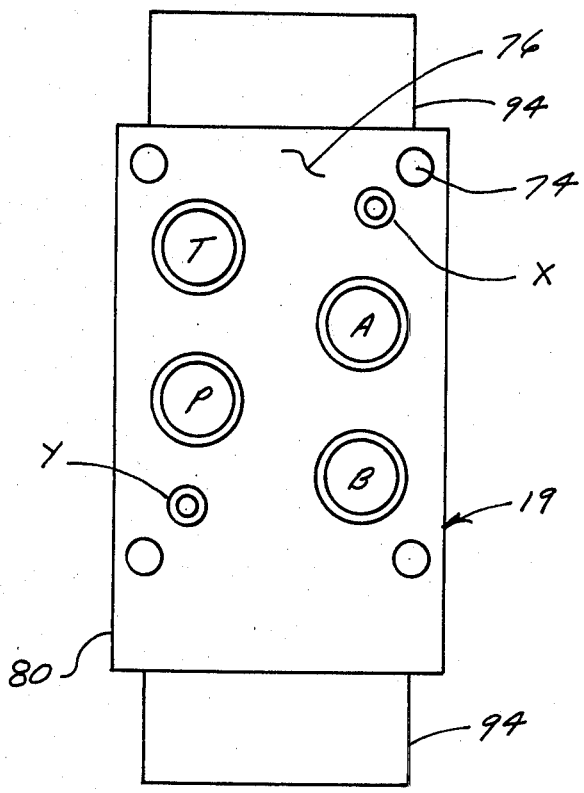
Figure 7:
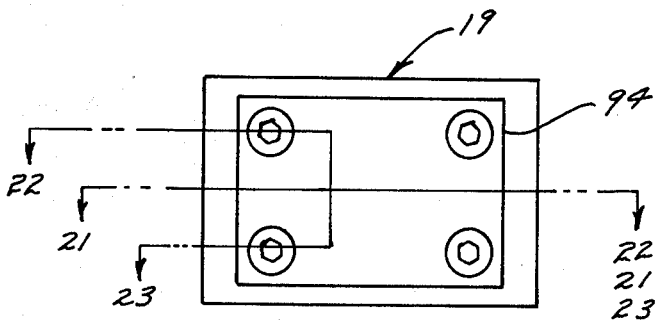
Figure 8:
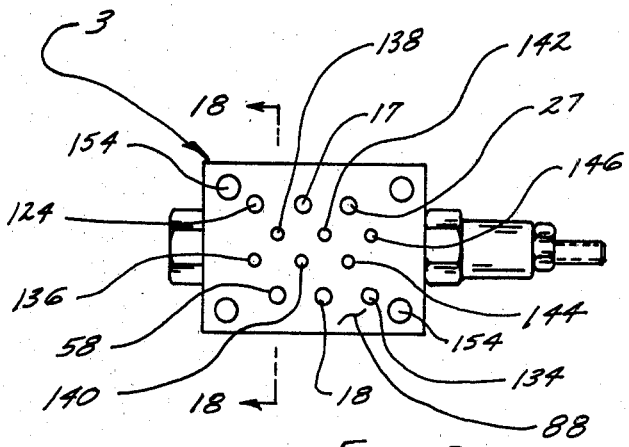
FIGS. 8,9,10 and 11 are top, right, bottom, and end elevational views, respectively of a pressure limiting module comprising another standardized module of the present invention.
Figure 10:
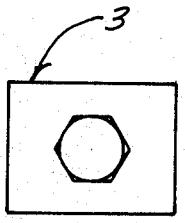
Figure 9:
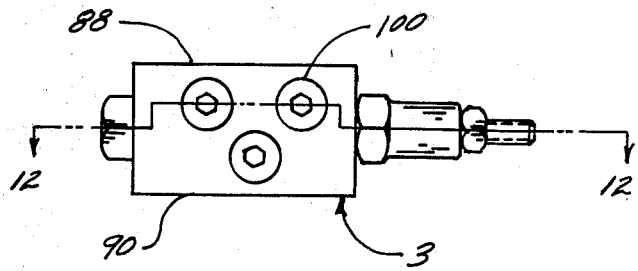
Figure 11:
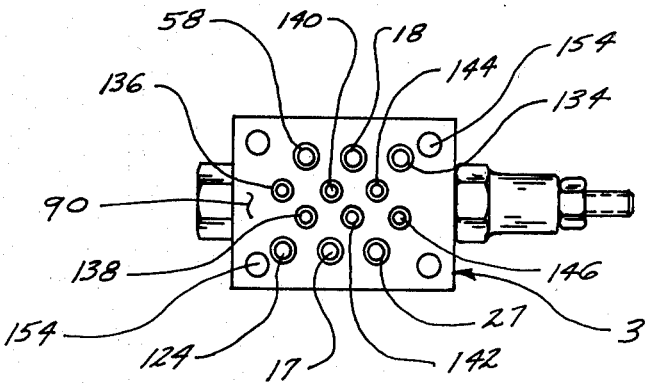

Referring in detail to the drawings, a preferred embodiment of a three position four way directional control apparatus constructed in accordance with the present invention, is illustrated in FIGS. 1 through 24. For purposes of simplicity and clarity this embodiment will be described as a typical example with specific reference to the diagrammic fluid circuit shown in FIG. 24. The passages, orifices, plugs, and elements refered to herein are given corresponding reference numbers in FIGS. 1 through 23, which illustrate an assembly of the standardized modules of the present invention.

Two signal flow switching modules 3-A and 3-B include standard interfaces, standard ports and movable elements in the form of standard signal flow spools 7 and 8 which in turn include annular spool grooves 9, 10, 15 and 16. Spools 7 and 8 are biased by springs 11 and 12 to a deenergized position and actuated by solenoids 13 and 14 so as to make line connections through annular spool grooves 9 and 15 to achieve the desired signal flows to shift a shiftable power flow element or power spool 20 as later described.

Referring again to FIG. 24 output flow from a hydraulic pumping apparatus is delivered via line 2, annular passage 25 and line 58 and 138 to an annular passage 5 of a signal flow pressure limiting module indicated generally at 3. Signal flow at reduced pressure enters line 59 and continues to a signal flow switching module 3-A and then via line 4 to an annular groove 15 of signal flow switching module 3-B.

It should be mentioned that pressure limiting module 3 is not always required in the signal flow circuit, but when required, provides for a reduced signal flow pressure as compared to the power flow pressure.

The directional control apparatus also comprises a main power valve module indicated generally at 19 which includes a standard power spool 20 that is biased in the neutral position by springs 21 and 22 and includes annular spool grooves 23 and 24. Power valve module 19 is provided with fluid chambers 25 and 26 at the ends of power spool 20 which provide control areas upon which fluid pressure in chambers 25 and 26 exert a force and shift the power spool responsive to signal flow switching module 3-A and 3-B. When the signal flow switching modules 3-A and 3-B are in the de-energized position, fluid chambers 25 and 26 are connected to a reservoir via lines 17 and 18, annular spool grooves 10 and 16 with both spool grooves communicating with drain line 27 leading back to the reservoir.

When signal flow switching module 3-A is actuated by solenoid 13 signal spool 7 moves against bias spring 11 and line 59 is connected to line 18 via annular spool groove 9.

As the pressure in line 59 increases it pressurizes chamber 26 via line 18 which forces power spool 20 to move against bias spring 21. As power spool 20 moves line 2 from pump 1 communicates with line 28 via annular spool groove 24 and at the same time line 29 drains chamber 34 via annular recess 23 and line 27. Line 28 then delivers pressurized fluid to chamber 33 of an actuator 32 causing work to be accomplished in one direction as pressurized fluid is applied to chamber 33.

De-energizing solenoid 13 of switching module 3-A causes bias spring 11 to return signal spool 7 to the de-energized position breaking the connection between line 59 and line 18 and in the de-energized position line 18 is connected to line 27 via annular spool groove 10 at the same time drain line 27 is connected to reservoir which vents chamber 26 and allows bias spring 21 to return power spool 20 to the neutral position breaking connection between pressure line 2 from the pump and line 28 leading to the actuator via annular spool groove 24. Hence, this action terminates the flowing of pressurized fluid to actuator 32 whereby movement of the actuator ceases.

When signal flow switching module 3-B is actuated by solenoid 14 the signal spool 8 moves against bias spring 12. This action connects line 4 to line 17 via annular spool groove 15. As the pressure in line 4 increases it pressurizes chamber 25 of the power module 19 via line 17 which forces power spool 20 to move against bias spring 22. As power spool 20 moves line 2 communicates with line 29 through annular spool groove 23. At the same time line 28 communicates via annular spool groove 24 to drain line 27 allowing actuator to return as fluid is vented from actuator chamber 33.

De-energizing solenoid 14 causes bias spring 12 to return signal spool 8 to the de-energized position breaking the connection between line 4 and 17 via annular spool groove 15. In the de-energized position drain line 17 is connected to drain line 27 leading to reservoir via annular spool groove 16, which vents chamber 25 and allows bias spring 22 to return power spool 20 to the neutral position. This action isolates line 29 from pressure line 2 via annular spool groove 23 and terminates the flow of fluid from the actuator causing it to stop movement.

It should be pointed out that spool spacer elements 70 and 72 are respectively positioned at opposite ends of power spool 20, as seen in FIGS. 19, 21, 22, and 23. Such spacer elements 70 and 72 can be selectively positioned with both elements on either end of power spool 20, so as to selectively establish the centered position of spool 20. For example, if both spool spacer elements are positioned on the right end of power spool 20, then ducts P and A are normally connected and ducts B and T are also connected via path 27, FIG. 19. If both spool spacer elements are positioned on the left end of the spool, the opposite connections P to B and A to T, become the normal connection. Hence, it will be understood that the spool spacer elements 70 and 72 allow the spool element to selectively program flow paths between ducts.

SIGNAL FLOW MODULE

In the preferred embodiment of the control apparatus of the present invention an adapter module 6 is used in a novel manner to provide for the selective programming of various control circuits for the power flow. For this purpose the adapter module 6 is provided with six primary signal flow passages 66, 62, 56, 58, 60, and 17 as seen in the adapter module view of FIG. 17 and 24, as well as six secondary signal flow passages 230, 27, 234, 236, 238 and 18. These passages register with twelve passages of identical numeral designation on the top standard signal flow interface 80 of power flow valve module 19.

Adapter module 6 includes a bottom signal flow interface 86 that registers with interface 80 and a top standard signal flow interface 84 that includes standard porting to provide six primary and six secondary signal flow passages that register with signal flow passages in the standard bottom and top interfaces of pressure limiting module 3, as well as the standard bottom and top interfaces of switching modules 3-A and 3-B, and the bottom interface of a top cap 30.

Figure 20:
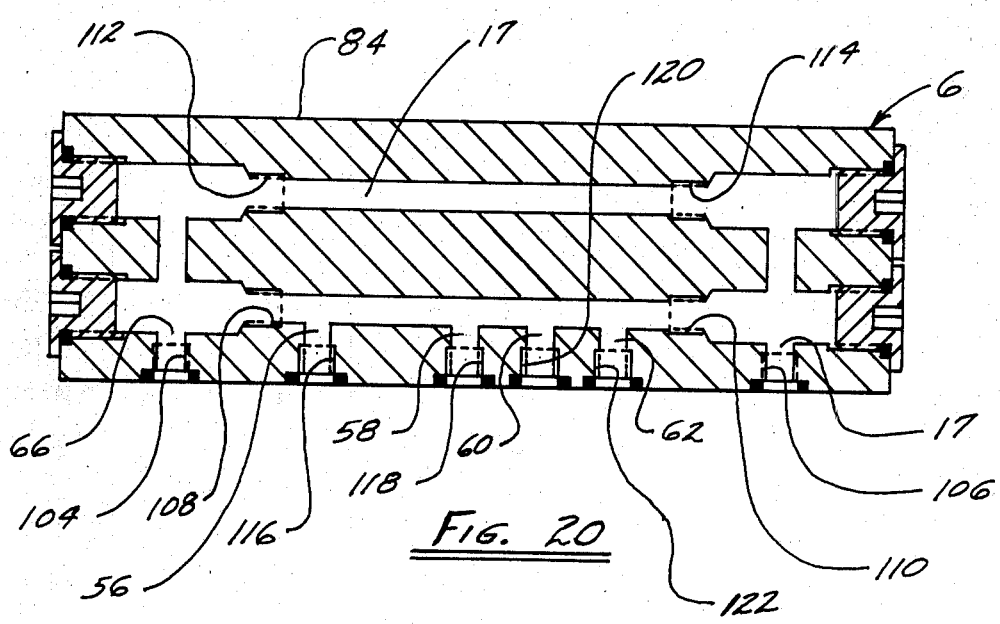
FIG. 20 is a sectional view of the adapter module of FIGS. 13 thru 17, with the section being taken along a vertical plane thru transverse passages with said module.
Figure 19:
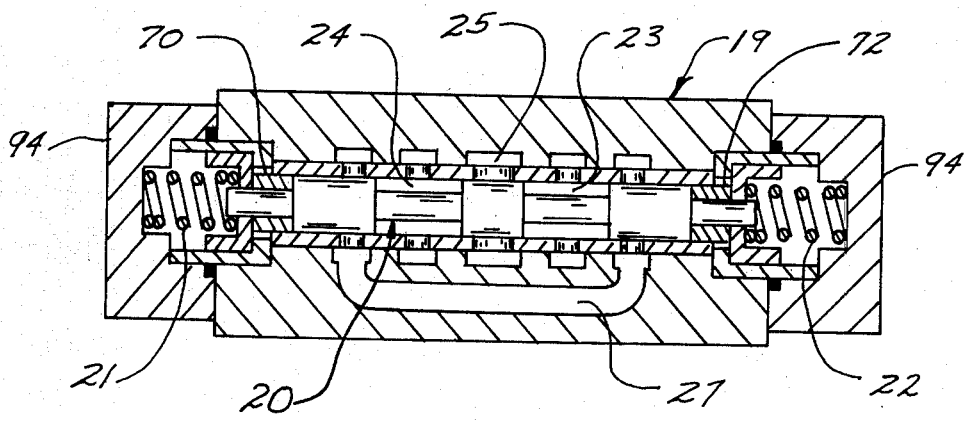
FIG. 19 is an enlarged partial sectional view of the main power module of FIG. 1, with the section being taken through the centerline of a power flow spool spacer apparatus within said module.
Figure 23:
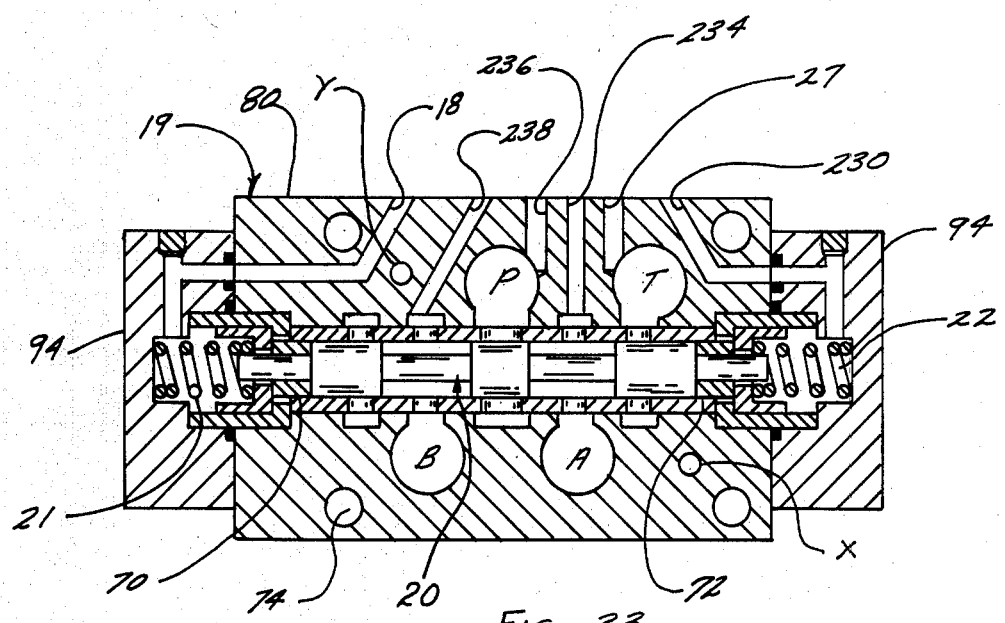
FIGS. 22 and 23 are off-set sectional views of the power valve module of FIGS. 2 thru 7, with the sections being taken along lines 22—22 and 23—23, respectively of FIG. 6.
Figure 22:
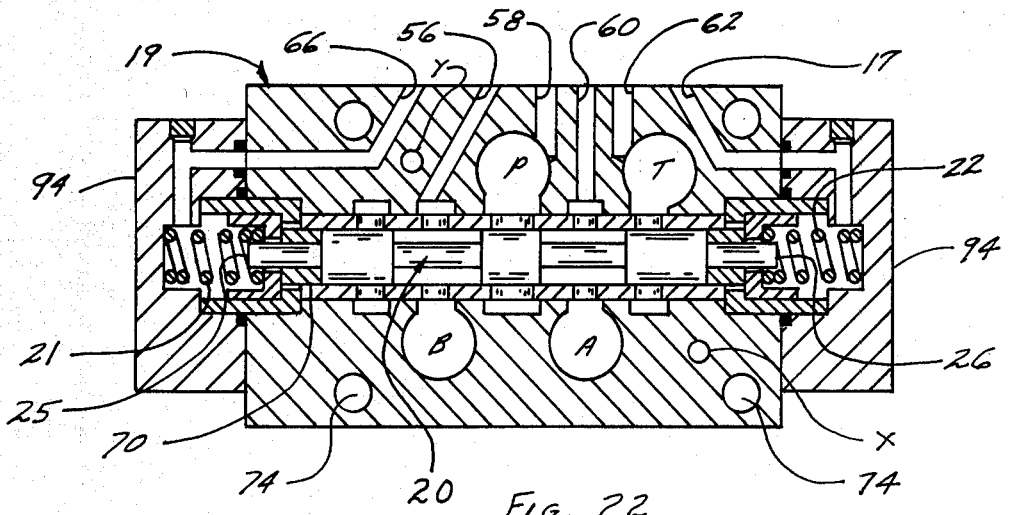

It should be pointed out that top interface 84 of adapter module 6 is different with respect to its porting arrangement from the porting arrangement of bottom interface 86 previously described. Such top porting arrangement, however, is standardized with respect to all signal flow modules stacked above the adapter module. This difference in adapter interface porting is used in the present apparatus, so as to make possible a unique internal network of interconnecting passages and removeable plugs designed into adapter module 6, as seen in the sectional view of FIG. 20. Such view of FIG. 20 shows only the above mentioned six primary passages. It will be understood that the six secondary passages are a duplication, not illustrated, located at a different vertical plane through the adapter module.

Figure 14:
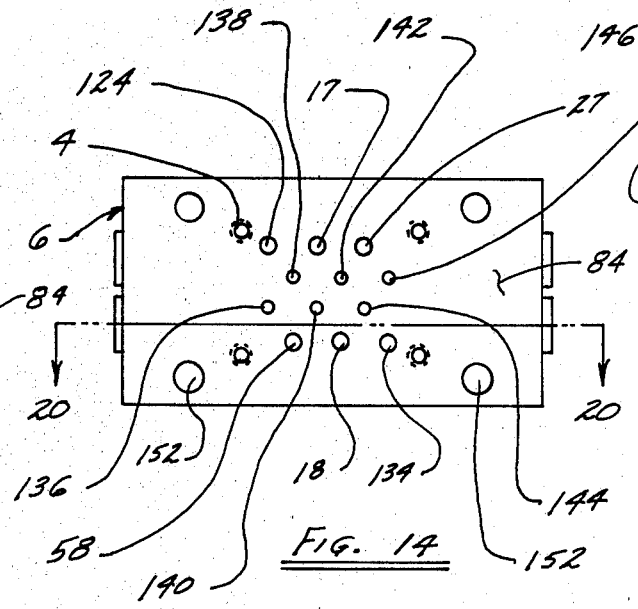
Figure 15:
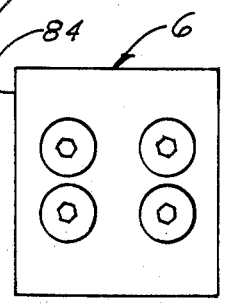
Figure 16:
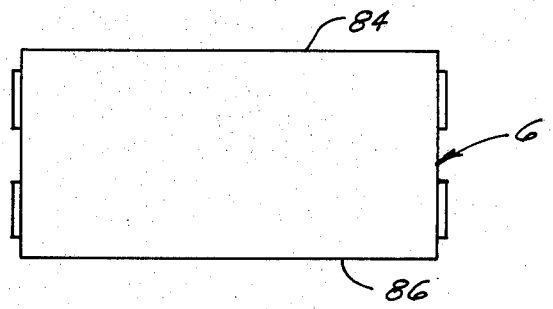
Figure 17:
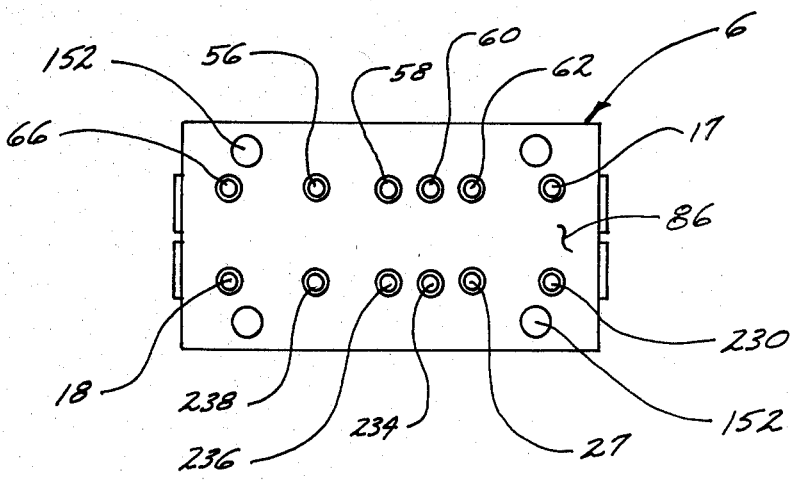

Referring to FIG. 14, the passages in top adapter inteface 84 are six primary passages 124, 58, 17, 18,27,134 and the six secondary passages are 136, 138, 140, 142, 144 and 146.

It will be understood from the above that all three of the signal flow modules 3, 3-A and 3-B are identical with respect to the housing and passages of each. The internal operating components of each, such as the spools, springs, solenoid actuators and plug arrangements differ depending on the selected control function.

Figure 24:
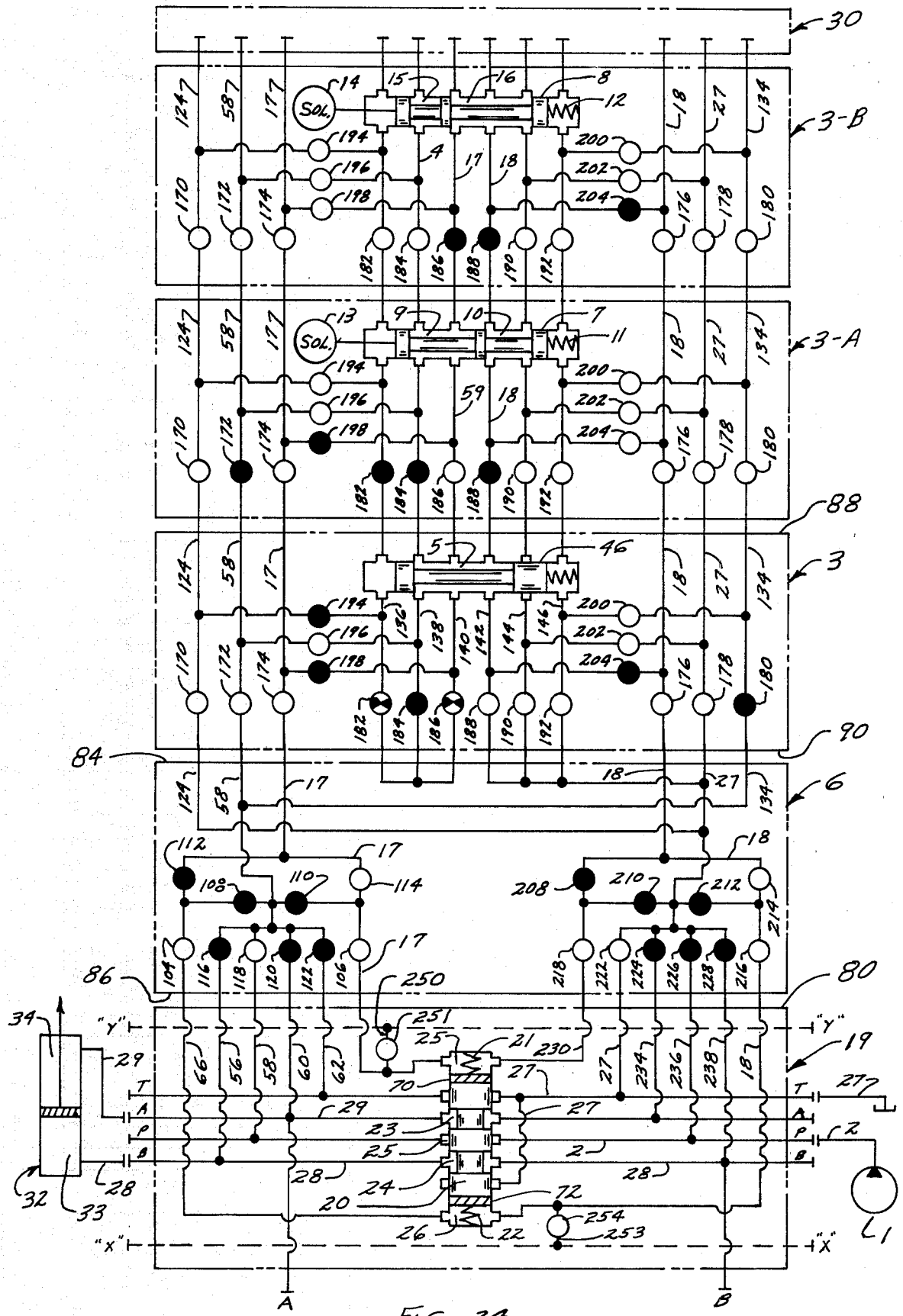
FIG. 24 is a diagrammatic view of the directional control apparatus of FIG. 1.
Figure 25:
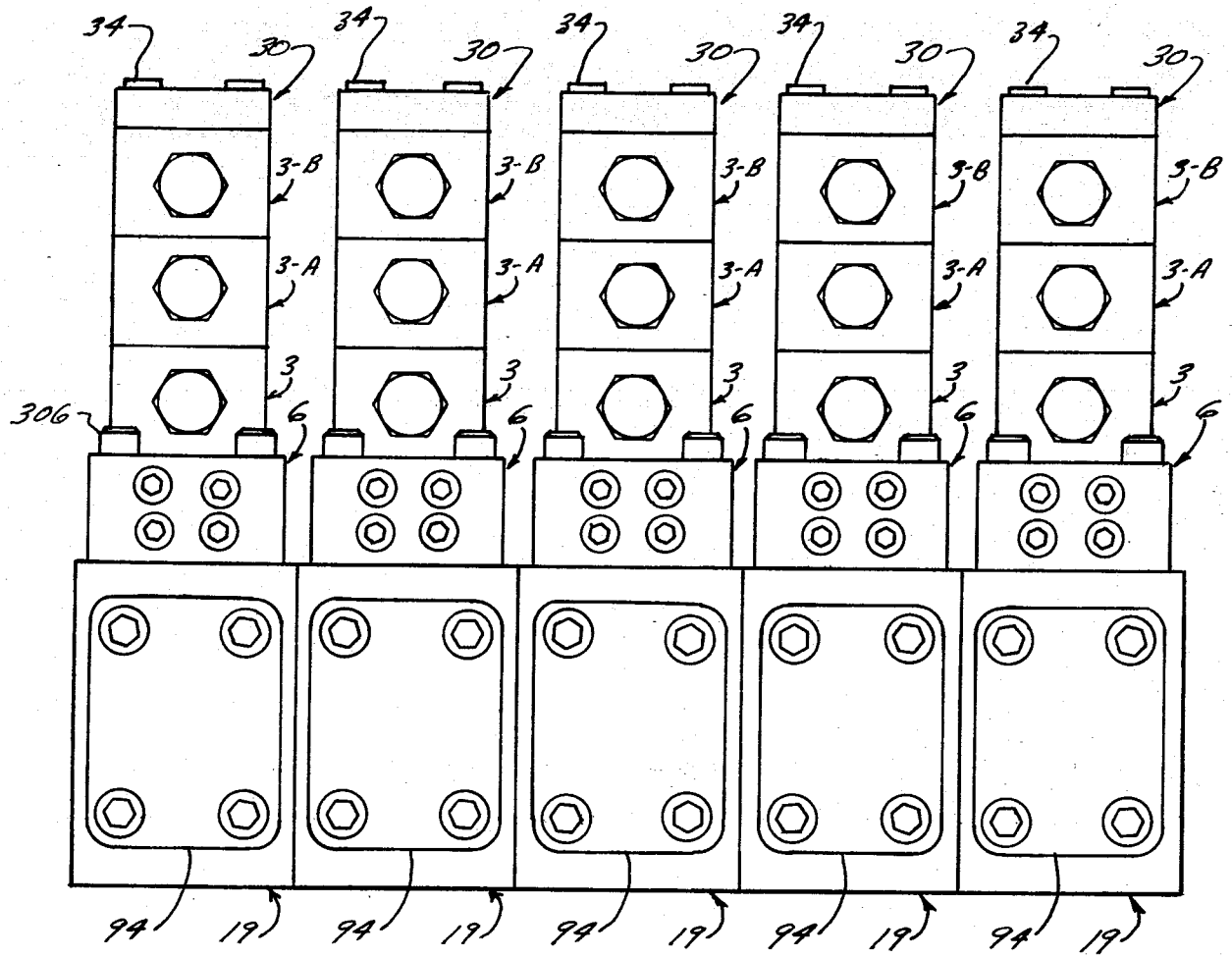
FIG. 25 is a side elevational view of the control apparatus of FIG. 10.

Referring to the power flow module, and particularly FIGS. 19, 21, 22, 23, and 24, the previously mentioned power flow ducts 2, 27, 28 and 29 are shown along with the symbols P, T, A and B which facilitate understanding of the flow circuit of FIG. 24. It should be further pointed out that there are two additional standardized passages X and Y which extend completely through each power flow module, so as to be connectable in series with adjacent modules.

Figure 21:
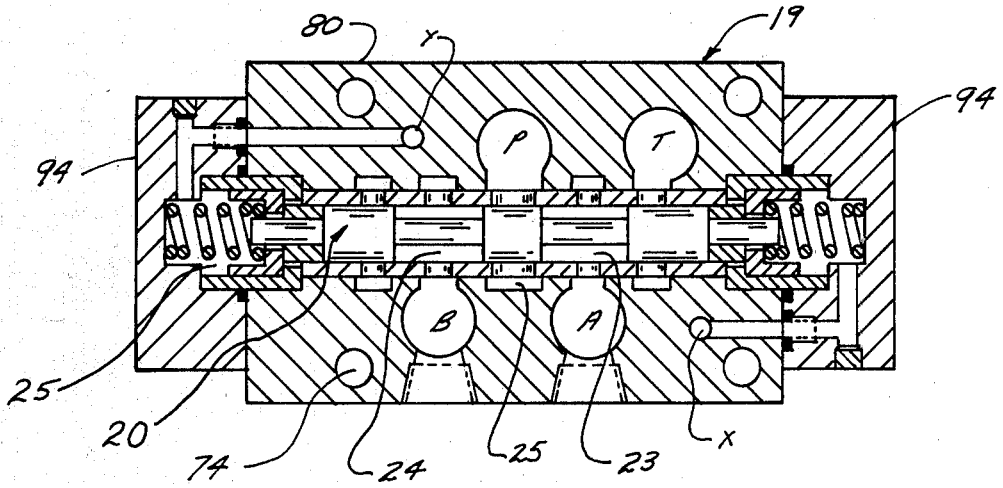
FIG. 21 is a center sectional view of the main power valve module of FIGS. 2 thru 7 with the section being taken along a vertical plane thru the center line of said module.

As seen in FIG. 21, passage Y is connectable with end chamber 25 via line 250 which line 250 is connectable, when desired, by plug option 251. Also, passage X is connectable with end chamber 26 via line 253 which is connectable, when desired, by plug option 254. It will now be understood that with the provisions of passages X and Y and a network of lines 250 and 253, any power flow module in a series assembly thereof, can be programmed to operate from signal flows from the signal flow module assemblies mounted on other power flow modules in the series.

Figure 12:
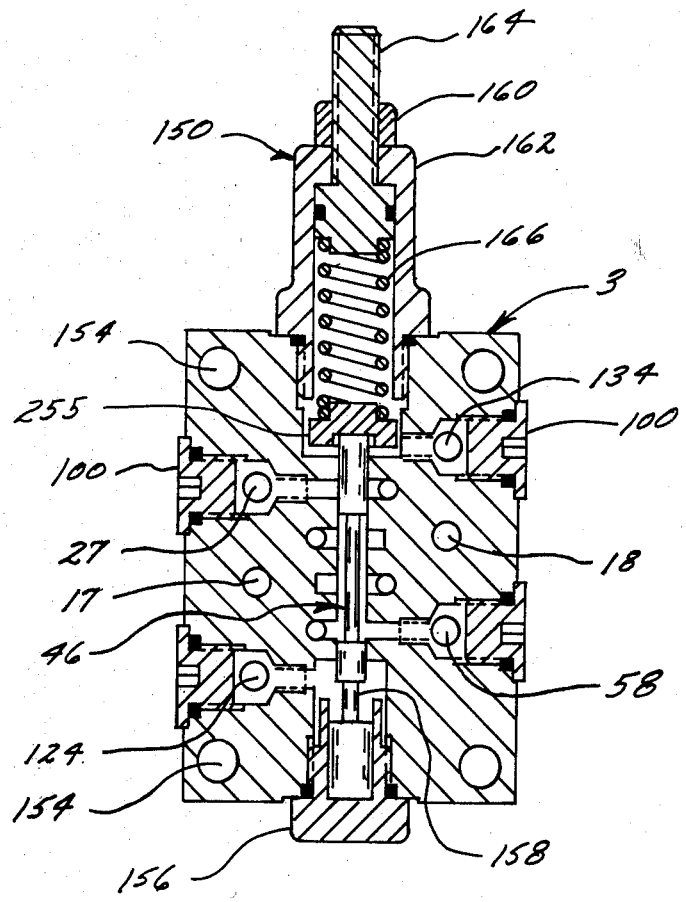
FIG. 12 is a top sectional view of the pressure limiting module of FIGS. 8 thru 11; with the section being taken along line 12—12 of FIG. 9.
Figure 18:
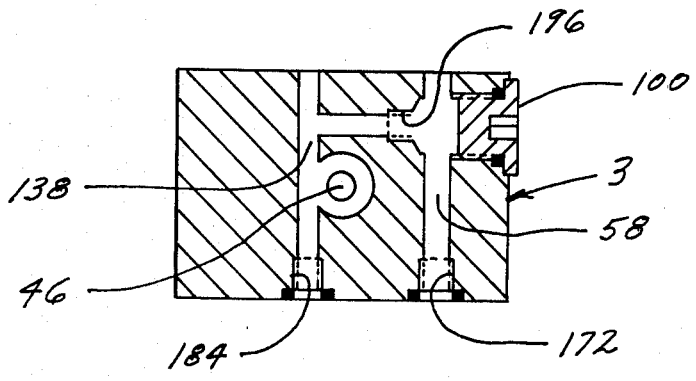
FIG. 18 is an end sectional view of the pressure limiting module of FIG. 1, with the section being taken along line 18—18 of FIG. 8.
Figure 13:
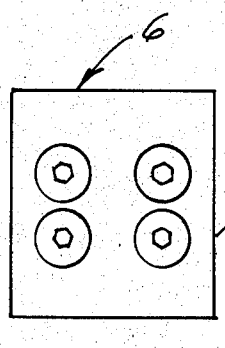
FIGS. 13, 14, 15, 16 and 17 are end, top, end, right, and bottom elevational views of an adapter module comprising another standardized module of the present invention.

Reference is next made to pressure limiting modules 3, and the sectional views of FIGS. 12 and 18 which illustrate the internal passages and components thereof. An adjusting stem 164 is in threaded engagement with a spring housing 162, so as to provide means for varying the bias spring pressure exerted by spring 166. Stem 164 is locked in position by a lock nut 160. A spring adapter 255 engages the end of previously described spool 46.

With reference to serial flow switching modules 3-A and 3-B the sectional views of FIGS. 12 and 18 still apply with respect to the passages, the housing and spool. However, a plug 156 is removed and replaced with a solenoid assembly 13 or 14, FIG. 24, and the manual adjusting stem can be eliminated as seen in FIG. 1.

Reference is next made to adapter module 6, and FIGS. 13–17, 20 and 24. It should be stated that the previously mentioned six primary passages 58, 124, 18, 17, 134, and 27, as well as the six secondary flow passages 136, 138, 140, 142, 144, and 148, are internally connected by passages which do not appear in the above mentioned elevated view. However, these passages are shown on the diagrammatic view of FIG. 24 as part of other numbered lines.

With continued reference to adapter module 6, the plug network illustrated at the various plugs are provided to program signal flows to and from any of the four power flow ducts 2, 27, 28 and 29 and the two signal flow ducts X and Y. In the particular example circuit of FIG. 24, it will be seen that the open circle such as 104 indicates an unplugged passage and a solid circle such as 116 indicates a plugged passage. Hence adapter module 6 is adapted to program, via the plug network, the various passage connections between the power flow module and the various signal flow modules.

It should be mentioned that the power flow valve modules are joined together in series relationship by rods, not illustrated, of preselected length which rods are extended through holes 74 shown in FIG. 1. Also all the signal flow modules are provided with mounting holes 154 which receive rods 34, FIG. 1, of preselected length which rods screw into threaded holes 4 provided in the top interface of adapter module 6. This module is in turn mounted on power flow valve module 19 by bolts 306.

It will also be understood that practically any selected valving functions, and assembled combinations thereof, can be programmed with the above described standardized modules merely by selecting the required number of standardized modules, and by assembling the modules with selected internal components and plugs as required to effect the desired control functions.

What is claimed is:

1. A fluid power control apparatus fabricated from a plurality of standardized components selectively adaptable to perform a plurality of valving functions, said apparatus comprising, in combination, a power flow valve module including a standard first power flow interface, a standard second power flow interface, and a standard signal flow interface; four standard duct-forming power flow passages extending between said first and second power flow interfaces and communicating with said signal flow interface; a shiftable power flow element mounted in the power flow valve module and including first and second end surfaces; two standard duct-forming signal flow passages extending between said two power flow interfaces and said signal flow interface and communicating with said end surfaces; a standard signal flow module including a standard first signal flow interface, a standard second signal flow interface, six standard primary signal flow passages, and six standard secondary signal flow passages; and a standard adapter module including a standard first adapter interface that registers with said signal flow interface on the power flow module, and a standard second adapter interface that registers with said signal flow interfaces on the signal flow module.

2. The apparatus defined in claim 1 wherein said power flow valve module includes a standard sleeve, and wherein said shiftable power flow element is mounted in the sleeve; a longitudinally extending guide at each end of the sleeve; and a spring adapter in said guide and including a shoulder biased in one direction by a control spring.

3. The apparatus defined in claim 2 wherein said sleeve can be selectively adapted to bridge power flow ducts extending between said first and second power flow interfaces.

4. The apparatus defined in claim 1 that includes two removeable spacer elements that are selectively positionable at ends of the shiftable power flow element whereby the power flow element is selectively positionable for either normally open or normally closed operation.

5. A fluid power control apparatus fabricated from a plurality of standardized modules selectively adaptable to perform a plurality of valving functions, said control apparatus comprising a standard power flow valve module including oppositely facing first and second standard power flow interfaces adapted to register with conforming standard power flow interfaces of subsequent standard power flow valve modules assembled in series relationship therewith, said power flow module including a standard signal flow interface; four standard duct-forming power flow passages extending between said power flow interfaces; a shiftable power flow element mounted in the power flow module for controlling flow between said power flow passages, said power flow element including first and second end surfaces, two standard duct-forming signal flow passages each of which extends between said power flow interfaces and said signal flow interface and communicates with a respective end surface of the power flow element; a signal flow module mounted on said power flow valve module and including at least one standard signal flow interface of the power flow valve module whereby the signal flow module receives fluid signal from said power flow ducts and delivers fluid signals to said signal flow passages and end surfaces.

6. The apparatus defined in claim 5 wherein said signal flow module includes oppositely facing switching module interfaces for stacking adjacent signal flow modules and wherein the power flow valve module includes at least six standard signal flow passages on the next adjacent signal flow module.

7. The apparatus defined in claim 5 wherein said signal flow module includes oppositely facing switching module interfaces for stacking adjacent signal flow modules and wherein the power flow valve module includes six standard primary signal flow passages that register with six standard signal flow passages on the next adjacent signal flow module; and six standard secondary signal flow passages that register with six standard secondary signal flow passages on said next adjacent signal flow module.

8. The apparatus defined in claim 7 wherein said signal flow module includes programable passages for selectively interconnecting said primary and secondary signal flow passages.

9. The apparatus defined in claim 5 wherein said signal flow module includes oppositely facing switching module interfaces for stacking adjacent signal flow modules and wherein the power flow valve module includes four standard power flow passages for delivering and draining fluid in series flow between a plurality of the power flow valve modules, wherein the power flow valve module includes six standard primary signal flow passages that register with six standard signal flow passages on the next adjacent signal flow module; and six standard secondary signal flow passages that register with six standard secondary signal flow passages on said next adjacent signal flow module.

10. In a fluid power apparatus, the combination of a plurality of standardized power flow valve modules each of which includes two oppositely facing standard power flow interfaces and four power flow passages each of which passages extends between said two interfaces, said plurality of modules being serially joined at said power flow interfaces with said power flow passages forming successive extensions of four power paths; a standardized signal flow interface on each of said power flow valve modules; a shiftable power flow element mounted in the power flow module for controlling flow between said power flow passages, said power flow element including first and second end surfaces; two standard duct forming signal flow passages each of which extends between said power flow surfaces and said signal flow interface and communicates with a respective end surface of the power flow element; a plurality of signal flow modules each of which includes oppositely facing switching module interfaces for stacking adjacent signal flow modules, each power flow valve module including at least six standard signal flow passages that register respectively with six standard signal flow passages on the next adjacent signal flow module.

11. In a fluid power control apparatus, the combination of a plurality of standardized power flow valve modules each of which includes two oppositely facing standard power flow interfaces and four power flow passages each of which passages extends between said two interfaces, said plurality of modules being serially joined at said power flow interfaces with said power flow passages forming successive extensions of four power paths; a standardized signal flow interface on each of said power flow valve modules; a shiftable power flow element mounted in the power flow module for controlling flow between said power flow passages, said power flow element including first and second end surfaces; two standard duct forming signal flow passages each of which extends between said power flow surfaces and said signal flow interface and communicates with a respective end surface of the power flow element; a plurality of signal flow modules each of which includes oppositely facing switching module interfaces for stacking adjacent signal flow modules, each power flow valve module including at least six standard primary signal flow passages that register respectively with six standard signal flow passages on the next adjacent signal flow module; and six standard secondary signal flow passages that register respectively with six standard secondary signal flow passages on the next adjacent signal flow module.

12. The apparatus defined in claim 11 wherein said signal flow module includes programable passages for selectively interconnecting said primary and secondary signal flow passages.

13. A fluid power flow apparatus fabricated from a plurality of standardized modules selectively adaptable to perform a plurality of valving functions, said control apparatus comprising a standard power flow valve module including a standard signal flow interface and oppositely facing first and second standard power flow interfaces of subsequent standard power flow valve modules assembled in series relationship therewith; four standard duct-forming power flow passages extending between said power flow interfaces; a shiftable power flow element mounted in the power flow module for controlling flow between said power flow passages, said power flow element including first and second end surfaces, two standard duct-forming signal flow passages each of which extends between said power flow interfaces and said signal flow interface and communicates with a respective end surface of the power flow element; an adapter module mounted on said power flow valve module and including opposite facing standard adapter interfaces that register with said signal flow interface and selectively programable adapter passages that extend between said adapter interfaces; a signal flow switching module mounted on the adapter module and including standard oppositely facing switching module interfaces that register with said adapter interfaces; a plurality of signal flow passages in the adapter module; a plurality of signal flow passages in the switching module that are serially arranged with said signal flow passages in the adapter modules for delivering pressurized fluid signals to said power flow valve module.

14. The apparatus defined in claim 13 wherein said signal flow module includes oppositely facing switching module interfaces for stacking adjacent signal flow modules and wherein the power flow valve module includes at least six standard signal flow passages that register with six standard signal flow passages on the next adjacent signal flow module.

15. The apparatus defined in claim 13 wherein said signal flow module includes oppositely facing switching module interfaces for stacking adjacent signal flow modules and wherein the power valve module includes six standard primary signal flow passages that register with six standard signal flow passages on the next adjacent signal flow module; and six standard secondary signal flow passages that register with six standard secondary signal flow passages on said next adjacent signal flow module.

16. The control apparatus defined in claim 13 wherein said power flow valve module includes a plurality of spool spacer elements removeably mounted at ends of the power spool for the selective programming of the valving function of the apparatus.

17. The control apparatus defined in claim 13 wherein said adapter module includes a plurality of standard removeable passage plugs in said signal flow passages for selectively programming the paths of the pressurized fluid signals delivered to the flow valve module.

18. In a fluid power apparatus, the combination of a plurality of standardized power flow valve modules each of which includes two oppositely facing standard power flow interfaces and four power flow passages each of which passages extends between said two interfaces, said plurality of modules being serially joined at said power flow interfaces with said power flow passages forming successive extensions of four power flow paths; a standardized signal flow interface on each of said power flow valve modules; four standard duct-forming power flow passages extending between said power flow interfaces; a shiftable power flow element mounted in the power flow module for controlling flow between said power flow passages, said power flow element including first and second end surfaces, two standard duct-forming signal flow passages each of which extends between said power flow interfaces and said signal flow interface and communicates with a respective end surface of the power flow element; an adapter module mounted on each of said power flow valve modules and including oppositely facing standard adapter interfaces that register with said signal flow interface and selectively programable adapter passages that extend between said adapter interfaces; a signal flow switching module mounted on each of said adapter modules and including standardized oppositely facing switching module interfaces that register with said adapter interfaces and a next adjacent signal flow module; a plurality of signal flow passages in each adapter module which passages are serially arranged with signal flow passages in a respective power flow valve module; and a plurality of signal flow passages in each switching module which passages are serially arranged with said signal flow passages in a respective adapter module for delivering pressurized fluid signals to a respective power flow valve module.

19. The apparatus defined in claim 18 wherein the power flow valve module includes at least six standard signal flow passages that register with six standard signal flow passages on the next adjacent signal flow module.

20. The apparatus defined in claim 18 wherein the power valve module includes six standard primary signal flow passages that register with six standard signal flow passages on the next adjacent signal flow module; and six standard secondary signal flow passages that register with six standard secondary signal flow passages on said next adjacent signal flow module.

21. The apparatus defined in claim 20 wherein said signal flow module includes programable passages for selectively interconnecting said primary and secondary signal flow passages.

22. The control apparatus defined in claim 18 wherein each power flow valve module includes a plurality of spool spacer elements removeably mounted at ends of the power spool for the selective programming of the valving function of the apparatus.

23. The control apparatus defined in claim 18 wherein each adapter module includes a plurality of standard removeable passage plugs in said signal flow passages for selectively programming the paths of the pressurized fluid signals delivered to the flow valve module.

* * * * *